US005729918A

United States Patent [19]

Smets

[11] Patent Number: 5,729,918

[45] Date of Patent: Mar. 24, 1998

[54] METHOD OF LASTING AN ARTICLE OF FOOTWEAR AND FOOTWEAR MADE THEREBY

[75] Inventor: Ben Smets, Portland, Oreg.

[73] Assignee: Nike, Inc., Beaverton, Oreg.

[21] Appl. No.: 727,336

[22] Filed: Oct. 8, 1996

[51] Int. Cl.[6] ..... A43B 9/02

[52] U.S. Cl. ..... 36/91; 36/18; 12/142 C; 12/145

[58] Field of Search ..... 36/91, 18, 19 R, 36/19 A, 21, 23; 12/142 B, 142 C, 145

[56] References Cited

U.S. PATENT DOCUMENTS

| | | | |
|---|---|---|---|
| Re. 26,700 | 10/1969 | Kamborian . | |
| 406,338 | 7/1889 | Cross | 36/19 R X |
| 1,163,848 | 12/1915 | Pierce et al. | 36/19 A |
| 1,458,719 | 6/1923 | McLeod | 36/91 |
| 1,480,278 | 1/1924 | McLeod | 36/19 R X |
| 1,602,675 | 10/1926 | Hurley | 36/91 |
| 2,038,528 | 4/1936 | McCarthy . | |
| 2,175,117 | 10/1939 | Hack et al. . | |
| 2,290,204 | 7/1942 | Nugent . | |
| 2,344,458 | 3/1944 | Colella . | |
| 2,574,485 | 11/1951 | Kneeland . | |
| 2,969,555 | 1/1961 | Kamborian . | |
| 2,984,918 | 5/1961 | Glassman . | |
| 3,076,215 | 2/1963 | Orlando . | |
| 3,082,450 | 3/1963 | Tumino . | |
| 3,090,772 | 5/1963 | Crowell . | |
| 3,116,501 | 1/1964 | Markevitch . | |
| 3,152,407 | 10/1964 | Richards . | |
| 3,298,116 | 1/1967 | Barker . | |
| 3,302,228 | 2/1967 | Bryant et al. . | |
| 3,341,873 | 9/1967 | Miller . | |
| 3,510,968 | 5/1970 | Hobbs, Jr. et al. . | |
| 3,523,379 | 8/1970 | Barsamian et al. . | |
| 3,538,527 | 11/1970 | Ioannilli . | |
| 3,568,338 | 3/1971 | Nadler . | |
| 3,626,532 | 12/1971 | Smith . | |
| 3,704,474 | 12/1972 | Winkler . | |
| 3,757,436 | 9/1973 | Winkler et al. . | |
| 3,821,827 | 7/1974 | Nadler . | |
| 3,909,862 | 10/1975 | Auberry et al. . | |
| 4,001,954 | 1/1977 | Taylor, Jr. . | |
| 4,027,406 | 6/1977 | Salvatore . | |
| 4,156,947 | 6/1979 | Nadler . | |

*Primary Examiner*—Ted Kavanaugh
*Attorney, Agent, or Firm*—Banner & Witcoff, Ltd.

[57] ABSTRACT

A method of lasting an article of footwear includes forming a pattern for a shoe upper from a first material, forming a pattern for a lasting sock from a second material, and stitching a perimeter of the lasting sock to a bottom edge of the shoe upper. The stitching extends from a first location rearward of an arch area of the shoe upper, around a heel area of the shoe upper, along a lateral side of the shoe upper, around a toe area of the shoe upper, and terminates at a second location forward of the arch area of the shoe upper such that the arch area remains unstitched. An adhesive is applied to the arch area of the shoe upper and it is thereafter adhered to the lasting sock.

10 Claims, 5 Drawing Sheets

METHOD OF LASTING AN ARTICLE OF FOOTWEAR AND FOOTWEAR MADE THEREBY

TECHNICAL FIELD

The present invention is directed to a method of lasting an article of footwear and an article of footwear that is made thereby and, in particular, to a method of lasting an article of footwear where the arch area of the article of footwear is not stitched or sewn to the insole, lasting sock or other similar component.

BACKGROUND OF THE INVENTION

Various methods of lasting such as string, cord, wire, slip, welt or cement lasting of the shoe uppers are well known in the manufacturing of footwear. In string lasting, as shown for example in U.S. Pat. No. 3,704,474 to Winkler, a string is loosely attached to the marginal edge or lasting margin of a shoe upper by a loose over stitch such that, when pulled, the string can slip within the confines of the over stitch. The shoe upper having the string attached thereto is then placed loosely over a foot mold or a last such that the shoe upper lasting margin is adjacent the last contoured or leathered edge which adjoins the last sides with the last bottom or sole. The lasting string is then dram or pulled tightly to thereby gather, pull and draw a portion of the shoe upper lasting margin over the last feather edge to closely conform the shoe upper to the contour of the last, and the lasted-over margin to the contour of the last feathered edge and at least the outer margin of the last sole.

In the construction of a welted last, a separate strip is attached to the underside of the insole and extends entirely or partially around the marginal portion of the insole. The strip is folded over inwardly to provide a flap-like sewing lip adapted to define a stitch-receiving channel. The upper material is then pulled over the insole and secured directly to the sewing lip; thereafter, the upper material is connected to the insole by inserting stitches through the channel and securing the flap-like sewing lip down flat so that it lies substantially flush with the underface of the insole and seals in the stitching. Welt lasting is shown is U.S. Pat. No. 3,298,116 to Barker, U.S. Pat. No. 3,341,873 to Miller, and U.S. Pat. No. 4,001,954 to Taylor, Jr.

When cement or adhesive is used to attach the margin of an upper to an insole or insole board, such as in U.S. Pat. No. 2,969,555 to Kamborian for example, it is customary to fold the lasting margin back, or outwardly, daub adhesive on the margin of the folded back upper with a brush and then wipe the upper inwardly against the bottom. Another way of applying the adhesive is to use a spray gun or similar device for atomizing the adhesive and to spray it forcibly against the exposed margin. Such methods have proved unsuccessful, however, either because not enough adhesive was applied or the adhesive was squeezed out during the lasting process such that not enough remained to hold the lasting margin against the stresses of the upper. In addition, the use of the insole board in this type of lasting is generally made from cardboard or fiber, which is considerably heavier than the fabric sockliners used in types of lasting. The lasting margin, three-quarters inch or more, that is folded over and the cement thereon also add additional weight to the final product.

Slip lasting is a simpler and a more economical method for lasting than those discussed above, and it provides a lighter weight shoe for the final product. In slip lasting, the stitching is performed by using a strobel machine to simply stitch together the adjacent lower edge of the upper and the perimeter edge of the sockliner, which in this case may be fabric or any other lightweight material. The stitched shoe upper is then slipped over a last for the final processing. Strobel stitching is successfully used in athletic footwear where it is desired to obtain a lightweight and comfortable shoe. However, in certain athletic footwear, such as running shoes, it is desirable for the arch area of the shoe upper to closely conform to the foot. However, strobel stitching does not allow the upper material to sufficiently conform to the contours of the arch area of the last during construction. Instead, the upper material merely bridges the arch area and creates a gap between the upper and the last. As a result, the final article of footwear does not snugly fit in the arch area.

SUMMARY OF THE INVENTION

The preferred embodiment of the present invention provides a method of lasting an article of footwear including forming a pattern for a shoe upper from a first material, forming a pattern for a lasting sock from a second material, and stitching a perimeter of the lasting sock to a bottom edge of the shoe upper. The stitching extends from a first location rearward of an arch area of the shoe upper, around a heel area of the shoe upper, along a lateral side of the shoe upper, around a toe area of the shoe upper, and terminates at a second location forward of the arch area of the shoe upper such that the arch area remains unstitched. An adhesive is applied to the arch area of the shoe upper such that the arch area of the shoe upper is adhered to the lasting sock. In a preferred embodiment, the shoe upper pattern is formed with an arch area projection.

After the perimeter of the lasting sock is stitched to the bottom edge or lasting margin of the shoe upper, the stitched shoe upper and lasting sock are disposed over a last or mold core. The adhesive is preferably applied to the arch area projection of the shoe upper and it is then stretched over the lasting sock and adhered thereto. Preferably, the shape of the arch area of the shoe upper is conformed to the shape of the last during the stretching and adhering of the arch area projection. After curing of the adhesive, the finished article of footwear is removed from the last.

BRIEF DESCRIPTION OF THE DRAWINGS

The above description and other objects, advantages, and features of the present invention will be more fully understood and appreciated by reference to the specification and accompanying drawings, wherein.

DETAILED DESCRIPTION OF THE PREFERRED EMBODIMENTS

Figure 1:
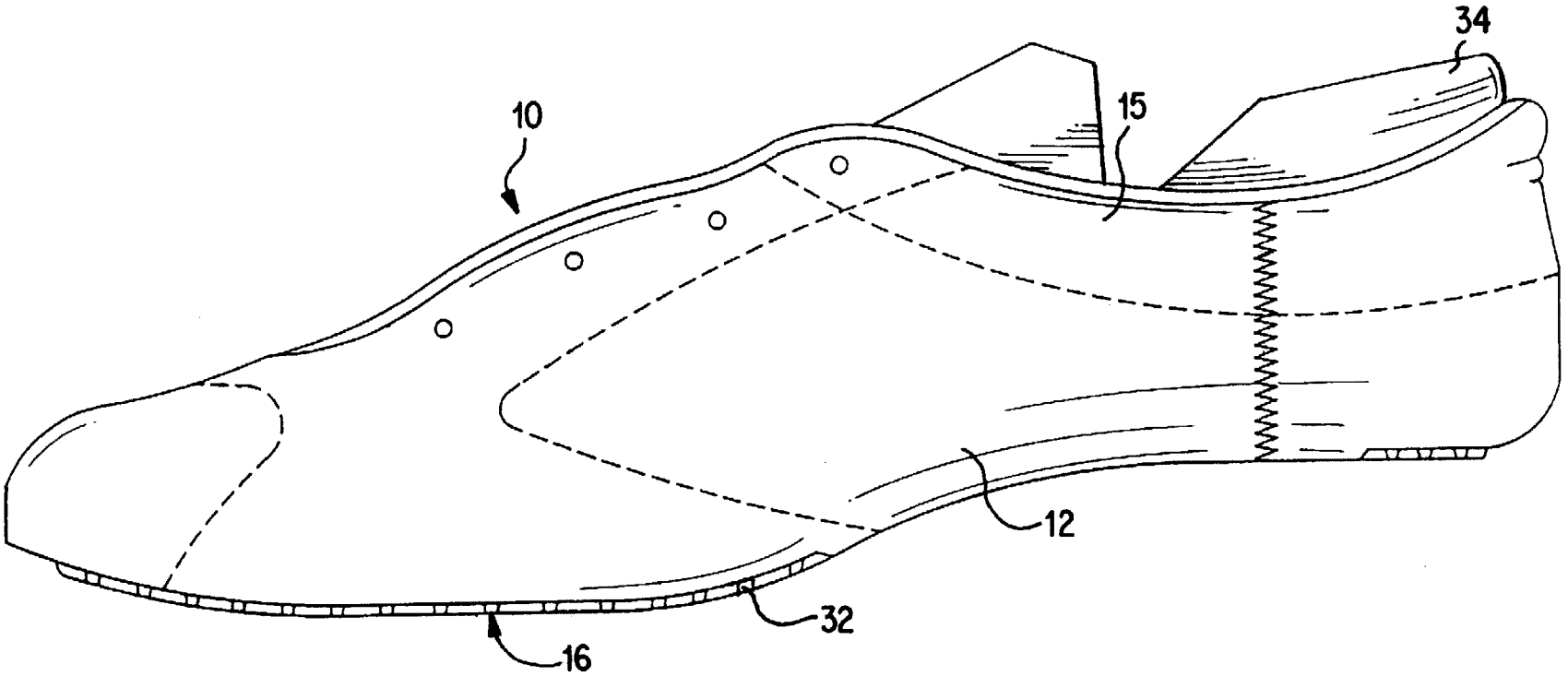
FIG. 1 is a side view of a shoe upper manufactured according to the method of the present invention.
Figure 2:
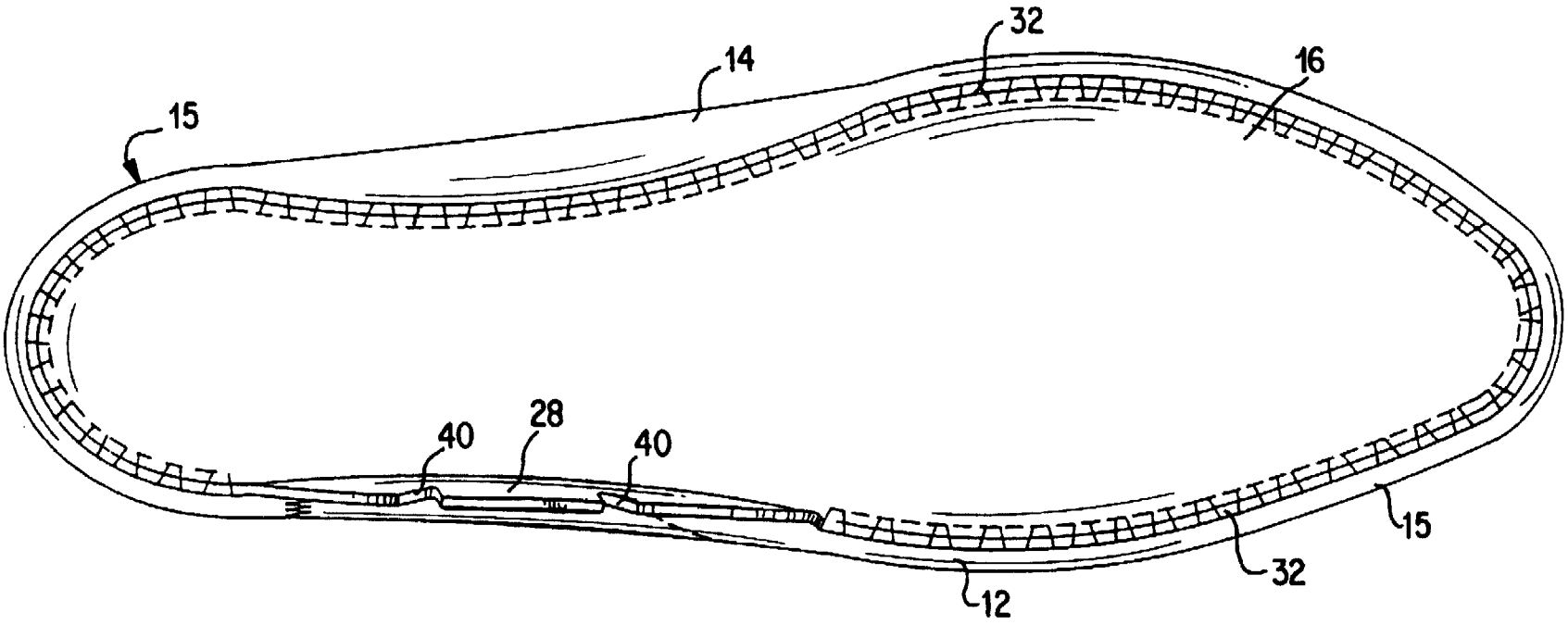
FIG. 2 is a bottom view thereof prior to completion of the manufacturing method.
Figure 3:
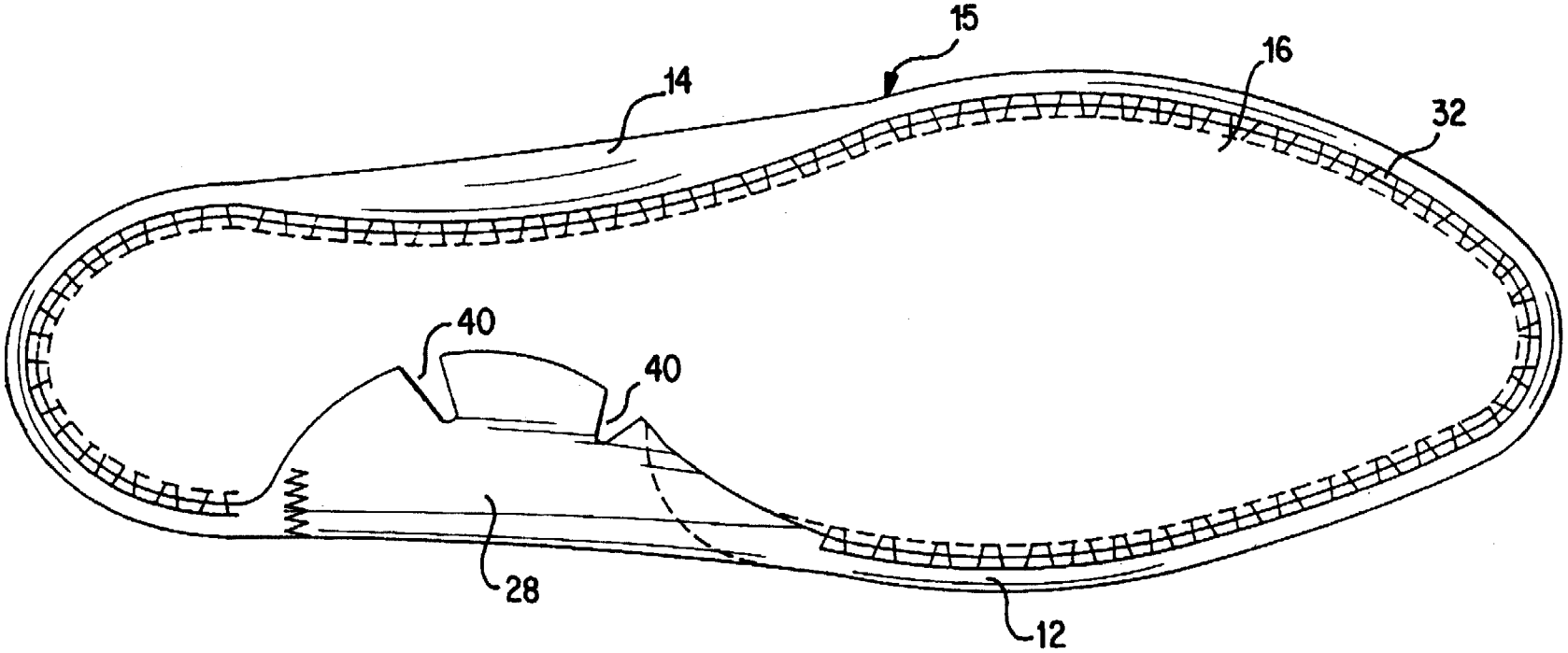
FIG. 3 is a bottom view of the shoe upper illustrated in FIG. 1.

The present invention is directed to a method of lasting an article of footwear such as a shoe, as generally shown by reference number 10 in FIGS. 1–3. The completed shoe 10 includes a medial side 12 and a lateral side 14 of a shoe upper 15 joined with lasting sock 16.

Figure 4:
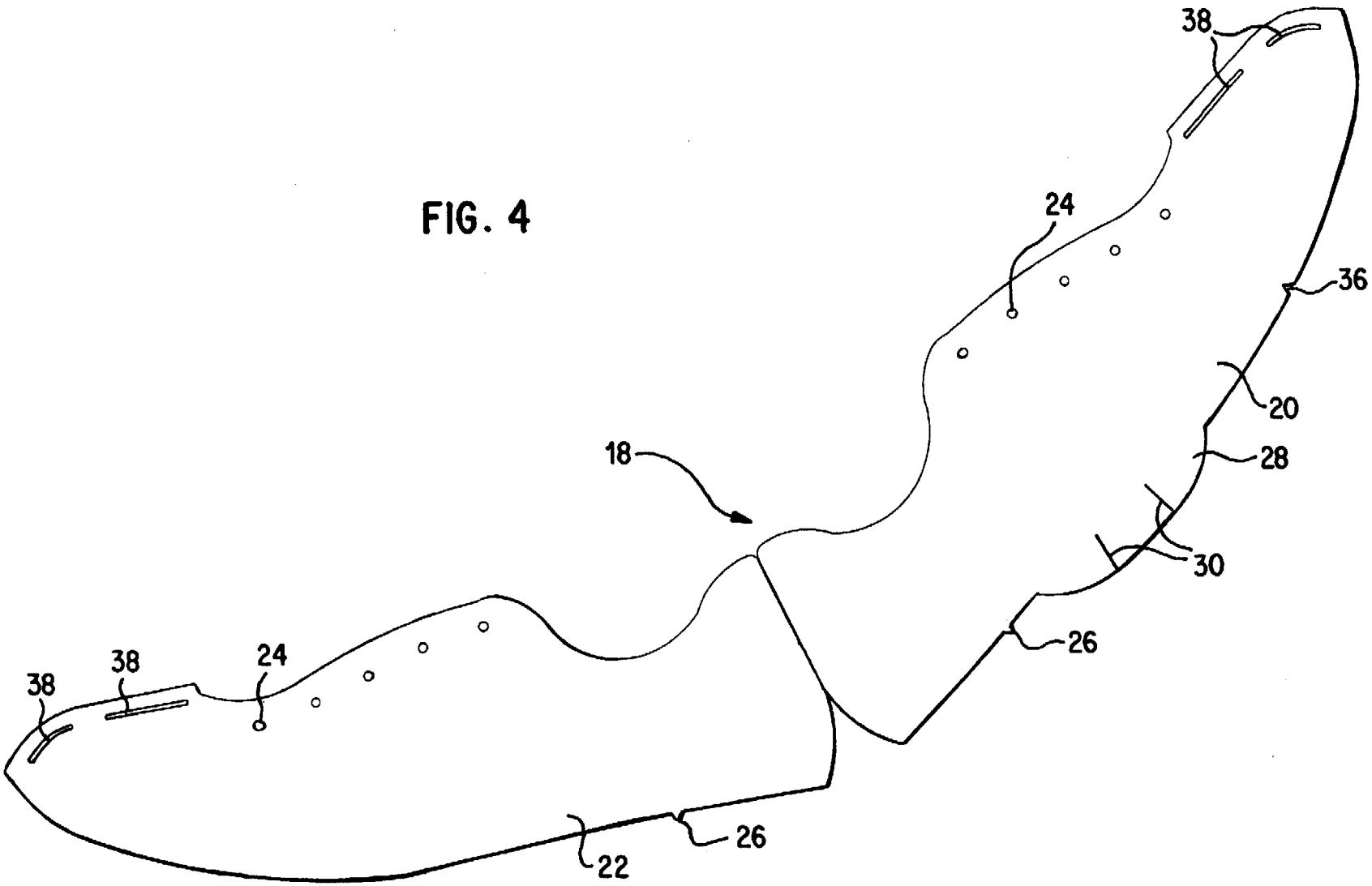
FIG. 4 is a plan representation of an upper pattern utilized in the method of the present invention.
Figure 5:
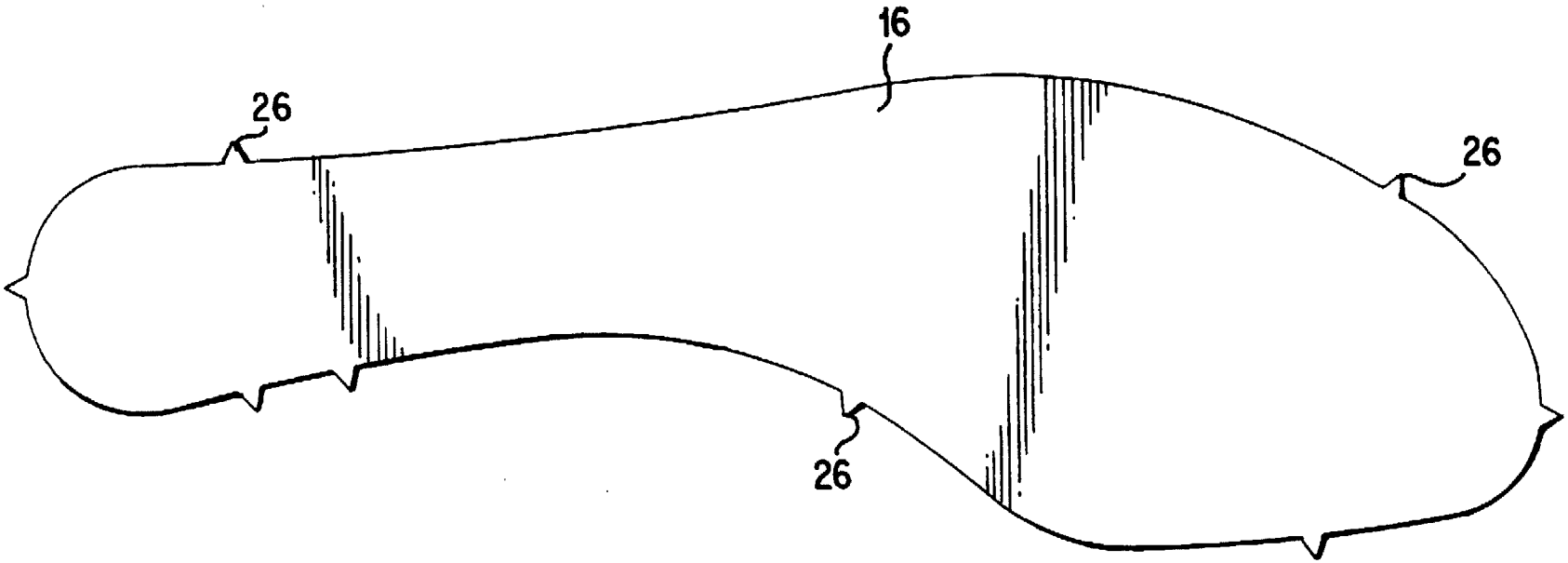
FIG. 5 is a plan representation of a sock liner pattern utilized in the method of the present invention.

Referring to FIGS. 4 and 5, the pattern 18 for shoe upper 15 includes a medial portion 20 and a lateral portion 22.

Pattern 18 preferably includes cut-out holes 24 that form the lace eyelets of the finished shoe upper. Additional slots 38 or holes may also be provided as stitching markers for the attachment of further elements if desired. Small positioning projections 26 and a positioning indentation 36 are also provided to assist in properly aligning the shoe upper with the lasting sock, as discussed further below. The medial portion 20 of pattern 18 also includes an arch area projection 28, preferably having slash lines 30 thereon to indicate the location for small cuts that are to be made in the material of the shoe upper. The pattern for lasting sock 16, as shown in FIG. 5, generally coincides with the shape of a wearer's foot and also includes a plurality of small positioning projections 26.

The patterns for shoe upper 15 and lasting sock 16 are used to cut the various components from a material, such as nylon, leather, or any other natural or synthetic material, and slash lines 30 are preferably cut into shoe upper 15 so as to form generally V-shaped elements 40 when the material is stretched. In a preferred embodiment, slash lines 30 are approximately five-eighths of an inch for an average size shoe. This length may be adjusted accordingly, however, depending upon the particular size of the shoe. The lasting margin or bottom edge 32 of shoe upper 15 is then turned over and stitched to the perimeter of lasting sock 16 using a conventional strobel stitching or any other conventional stitching, except for the arch area on the medial side thereof. The arch area corresponding to the location of projection 28 is left unstitched and unsewn. The attached shoe upper and lasting sock are then stretched over a last or mold core 34, as shown in FIGS. 1 and 2, with the arch area still unsewn. Referring to FIG. 3, the arch area projection 28 of shoe upper 15 and the arch area of lasting sock 16 are coated with an adhesive such as, preferably, a neoprene cement, contact cement, a heat activated cement or any other cement or adhesive. Before adhering the projection 28 to the sock liner 16, when using a neoprene cement, the cement is allowed to set for a predetermined period of time. In a preferred embodiment, the cement sets for approximately 15 minutes or longer. If the cement has been allowed to completely dry, for example one day or more, then the cement may need to be reactivated with heat before it can properly set for adhering the projection to the liner. When the cement has properly set, the arch area projection 28 of the upper is pulled over sock liner 16 using lasting pinchers or any other type of lasting apparatus. The lasting must be tight enough so that there is no excess space between the upper and the last 34. The presence of arch area projection and V-shaped elements 40 allows the upper material to bend and be shaped around the curve of the arch. Before the finished shoe upper is removed from last 34, an outsole is preferably attached to the bottom of sock liner 16 by adhesive or any other conventional attachment method. The finished footwear is allowed to sit for a predetermined time such that the adhesive substantially cures and the upper is shaped to the curvature of the last. As is commonly practiced depending on the equipment available, the setting time varies and may be for a day or more if air dried or it may be significantly reduced if heat tunnels or other conventional apparatus is employed.

By using a combination of stitching around substantially the entire periphery of the shoe upper and an adhesive applied to an arch area projection in the remaining arch region, the present invention overcomes the disadvantages of both prior art strobel stitched lastings and cemented lastings. That is, the present invention is able to obtain a lasting that closely conforms to the contour of the last, even in the arch area, and which can withstand the stresses placed upon the shoe upper during use. Thus, the shoe upper of the present invention provides a better fit and more closely conforms to the arch of the foot than those of the prior art. By eliminating the heavy board insole used with cement lasting, the shoe upper of the present invention is also lighter in weight and less expensive to manufacture than those of the prior art.

It can be readily understood that a variety of alternate or equivalent methods, processes and manufacturing techniques could be used to derive the article of footwear of the present invention. It will also be obvious to those of ordinary skill in the art that numerous modifications may be made without departing from the true spirit and scope of the present invention, which is to be limited only by the appended claims.

I claim:

1. A method of lasting an article of footwear comprising:

forming a pattern for a shoe upper from a first stock material;

forming a pattern for a lasting sock from a second stock material;

stitching a perimeter of the lasting sock to a bottom edge of the shoe upper, the stitching extending from a first location rearward of an arch area of the shoe upper, around a heel area of the shoe upper, along a lateral side of the shoe upper, around a toe area of the shoe upper, and terminating at a second location forward of the arch area of the shoe upper such that the arch area remains unstitched;

applying an adhesive to the arch area of the shoe upper;

adhering the arch area of the shoe upper to the lasting sock.

2. The method of claim 1 wherein said step of forming said shoe upper pattern includes forming an arch area projection.

3. The method of claim 2 further comprising after said stitching step, disposing the stitched shoe upper and lasting sock over a last.

4. The method of claim 3 wherein said step of adhering the arch area includes stretching the arch area projection over the lasting sock and adhering the arch area projection to the lasting sock.

5. The method of claim 4 wherein said step of applying the adhesive includes applying the adhesive to the arch area projection.

6. The method of claim 5 wherein said step of applying the adhesive includes applying a neoprene cement to the arch area projection.

7. The method of claim 4 wherein said stretching step includes conforming the shape of the arch area projection to the shape of the last.

8. The method of claim 6 wherein said step of applying the adhesive includes allowing the adhesive to set prior to said adhering step.

9. The method of claim 3 further comprising, after said adhering step, removing the article of footwear from the last.

10. An article of footwear comprising:

a shoe upper having a medial side including an arch area, a toe area, a lateral side, and a heel area;

a lasting sock secured to said shoe upper;

wherein a perimeter of said lasting sock is stitched to a bottom edge of said shoe upper, the stitching extending from a first location rearward of said arch area of the said upper, around said heel area of said shoe upper, along said lateral side of said shoe upper, around said toe area of said shoe upper, and terminating at a second location forward of said arch area of said shoe upper such that said arch area remains unstitched; and wherein said arch area of said shoe upper is adhered to said lasting sock.

* * * * *